United States Patent [19]

Onodera

[11] Patent Number: 4,571,571

[45] Date of Patent: Feb. 18, 1986

[54] VARIABLE RESISTOR ACUATED BY PIVOTAL ACTUATOR

[75] Inventor: Masahiro Onodera, Furukawa, Japan

[73] Assignee: Alps Electric Co., Ltd., Tokyo, Japan

[21] Appl. No.: 587,351

[22] Filed: Mar. 8, 1984

[30] Foreign Application Priority Data

Mar. 9, 1983 [JP] Japan ..... 58-32774[U]
Mar. 9, 1983 [JP] Japan ..... 58-32775[U]

[51] Int. Cl.[4] ..... H01C 10/32

[52] U.S. Cl. ..... 338/162; 338/160; 338/174; 338/119; 338/196; 338/184

[58] Field of Search ..... 338/119, 160, 162, 174, 338/196, 184

[56] References Cited

U.S. PATENT DOCUMENTS 2,324,383 7/1943 Grimes ..... 338/119 X
4,410,873 10/1983 Kuratani ..... 338/119 X

*Primary Examiner*—C. L. Albritton
*Assistant Examiner*—M. M. Lateef
*Attorney, Agent, or Firm*—Guy W. Shoup

[57] ABSTRACT

A variable resistor for use in a frequency regulator comprises an actuator having an intermediate portion pivotally supported by a casing, and a pair of opposite actuating end portions exposed from the casing. A pair of opposite feed pawls depend from the actuator to engage a rotor pivotally supported by the casing between the opposite feed pawls. The rotor has on peripheral edges thereof teeth meshing with the feed pawls, and carries a slider. A resistor base plate is mounted on the casing and has an arcuate resistor layer facing the slider of the rotor. The actuator is angularly movable in response to depression of one at a time of the actuating end portions thereof for turning the rotor in one direction through meshing engagement between the feed pawls and the teeth to thereby cause the slider to slide on the arcuate resistor layer. Therefore, the resistance of the variable resistor can be varied simply by pushing the actuator angularly back and forth. The variable resistor also includes a first light-emitting element for indicating operation of the variable resistor and a second light-emitting element for indicating an angular position of the rotor.

4 Claims, 17 Drawing Figures

VARIABLE RESISTOR ACUATED BY PIVOTAL ACTUATOR

BACKGROUND OF THE INVENTION

The present invention relates to a variable resistor for use in a frequency regulator in an audio device.

SUMMARY OF THE INVENTION

It is an object of the present invention to provide a variable resistor which can easily be operated with a reduced force.

Another object of the present invention is to provide a variable resistor which provides an optical indication of its operation.

According to the present invention, there is provided a variable resistor for use in a frequency regulator which comprises a swingable lever or actuator having an intermediate portion pivotally supported by a casing, and a pair of opposite actuating end portions exposed from the casing. A pair of opposite feed pawls depend from the actuator to engage a rotor pivotally supported by the casing between the opposite feed pawls. The rotor has on peripheral edges thereof teeth meshing with the feed pawls, and carries a slider. A resistor base plate is mounted on the casing and has an arcuate resistor layer facing the slider of the rotor. The actuator is angularly movable in response to depression of one at a time of the actuating end portions thereof for turning the rotor in one direction through meshing engagement between the feed pawls and the teeth to thereby cause the slider to slide on the arcuate resistor layer. Therefore, the resistance of the variable resistor can be varied simply by pushing the actuator angularly back and forth. The variable resistor also includes a first light-emitting element for indicating operation of the variable resistor and a second light-emitting element for indicating an angular position of the rotor.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
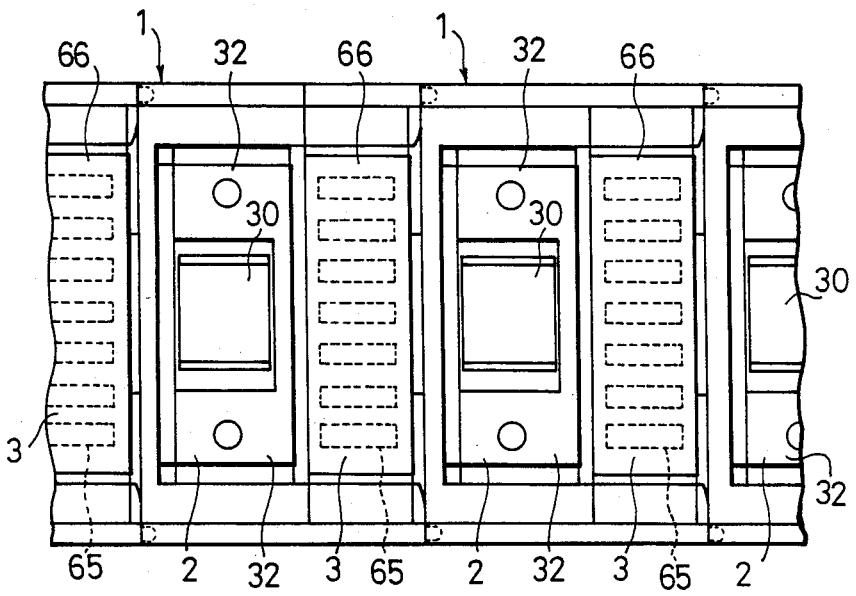
FIG. 1 is a fragmentary front elevational view of an array of variable resistors according to the present invention.
Figure 2:
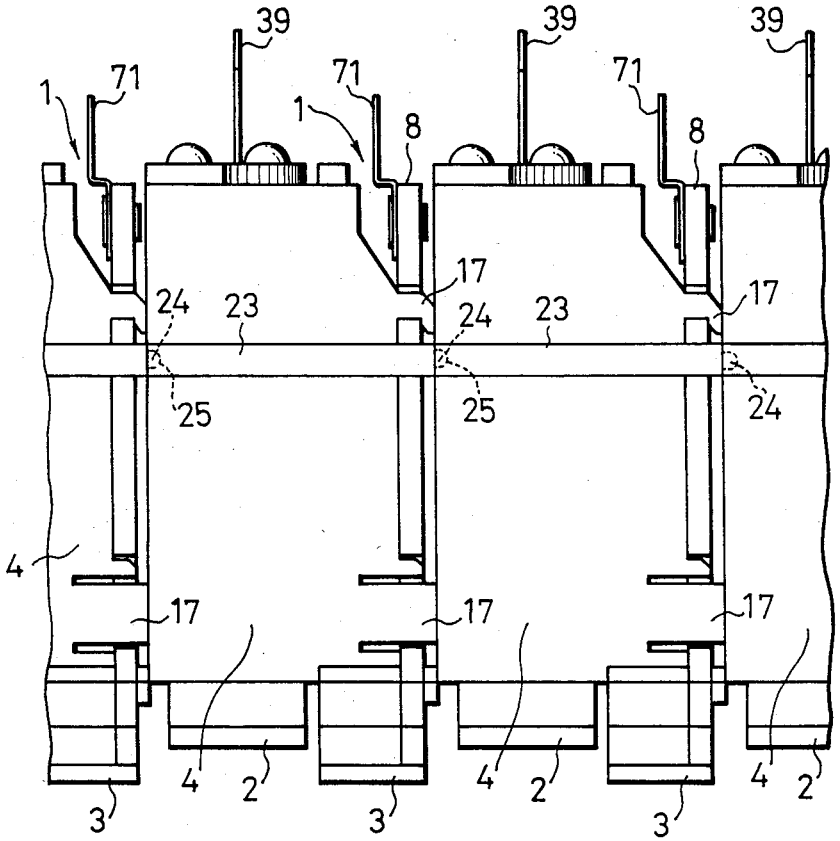
FIG. 2 is a fragmentary plan view of the array of variable resistors of the invention.

FIGS. 1 and 2 illustrate a plurality of variable resistors 1 constructed in accordance with the present invention. The variable resistors 1 are side-by-side in a row with their actuators 2 and level indicators 3 facing the operator. Although not shown, each of the actuators 2 has an actuating knob. The variable resistors 1 are assigned respectively to preset of an audio device so as to adjust the level of the respective frequency.

Figure 3:
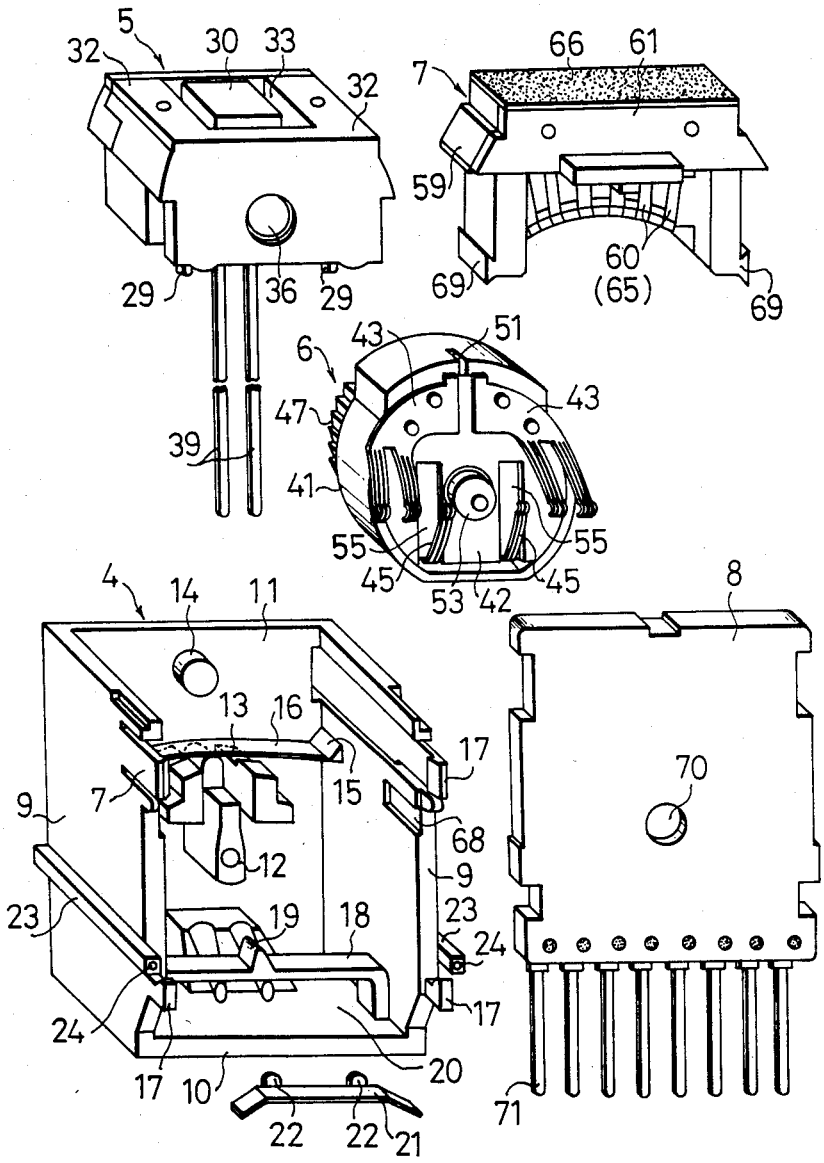
FIG. 3 is an exploded perspective view of the variable resistor.

The internal construction of each variable resistor 1 will now be described. As shown in FIG. 3, the variable resistor 1 is comprised mainly of a casing 4, an actuator block or swingable lever 5, a rotor 6, an indicator block 7, and a resistor base plate 8.

Figure 4:
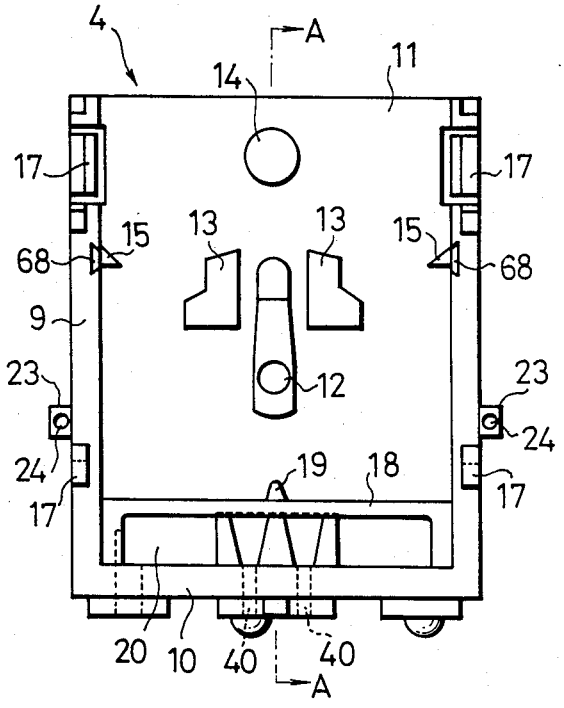
FIG. 4 is front elevational view of a casing.
Figure 5:
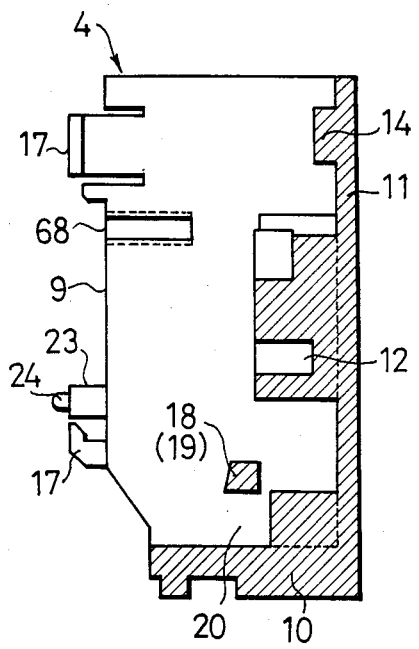
FIG. 5 is a cross-sectional view taken along line A—A of FIG. 4.

FIGS. 4 and 5 illustrate the casing 4. The casing 4 is molded of a synthetic resin such as polyacetal and primarily comprises a pair of side walls 9, 9, a bottom wall 10, and a rear wall 11 with front and upper open sides. The rear wall 11 has a substantially central hole 12, a pair of spring supports 13, 13 projecting from a portion thereof above the hole 12, and a support shaft 14 projecting above the spring supports 13, 13.

A pair of spring stoppers 15, 15 project respectively from inner surfaces of the side walls 9, 9 in substantially confronting relation to the spring supports 13, 13, respectively. As shown in FIG. 3, a leaf spring 16 has its intermediate portion resting on the spring supports 13, 13 and opposite ends resiliently held against lower surfaces of the spring stoppers 15, 15. The side walls 9, 9 include locking hooks 17, 17 on front edges thereof for locking the resistor base plate 8 on the casing 4.

A resilient member 18 is integrally molded with the inner surfaces of the side walls 9, 9 adjacent to the bottom wall 10 and interconnects the side walls 9, 9. The resilient member 18 has a ridge 19 of a triangular cross section which is positioned in vertical alignment with the central hole 12. The resilient member 18 and the bottom wall 10 jointly define therebetween a space 20 for receiving inserted a leaf spring 21 having a top portion held against a lower surface of the resilient member 18 and opposite ends held against the bottom wall 10. The top portion of the leaf spring 21 has a pair of stop projections 22, 22 engaging the resilient member 18 for preventing the leaf spring 21 from being displaced out of the leaf spring inserting space 20.

The side walls 9, 9 have on their outer surfaces a pair of straight ridges 23, 23 having pins 24 on front ends thereof and recesses 25 (FIG. 2) in rear ends thereof. As shown in FIG. 2, the variable resistors 1 are arranged in an array with their pins 24 fitted in the recesses 25 of the adjacent variable resistor.

Figure 6:
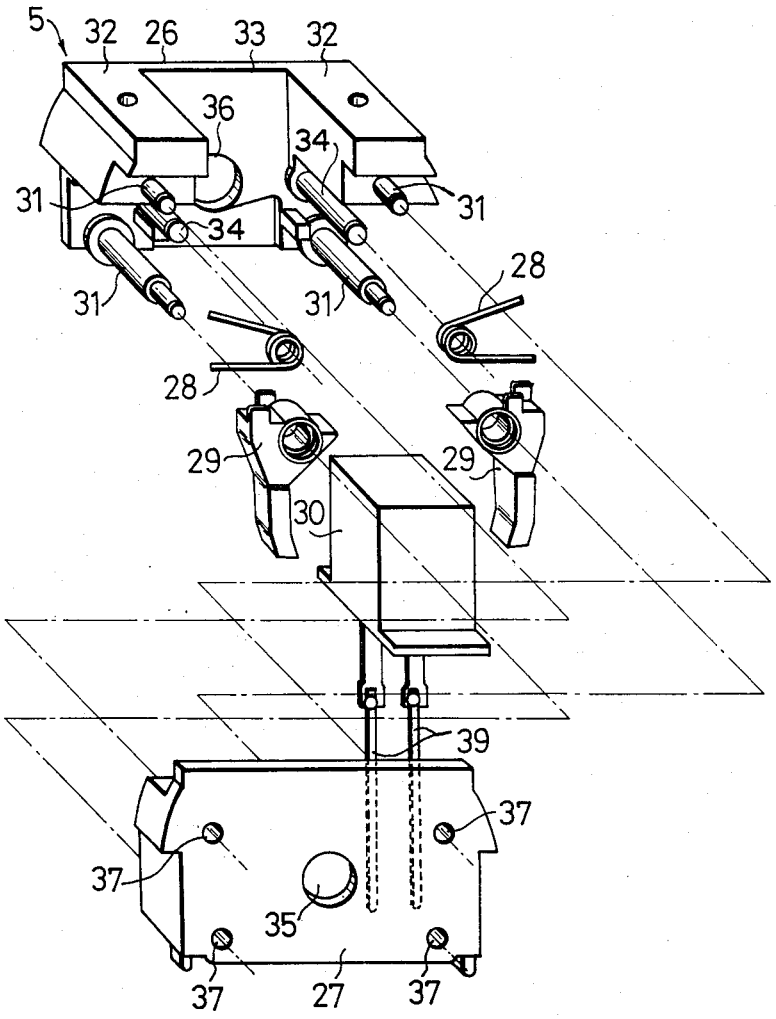
FIG. 6 is an exploded perspective view of an actuator.
Figure 7:
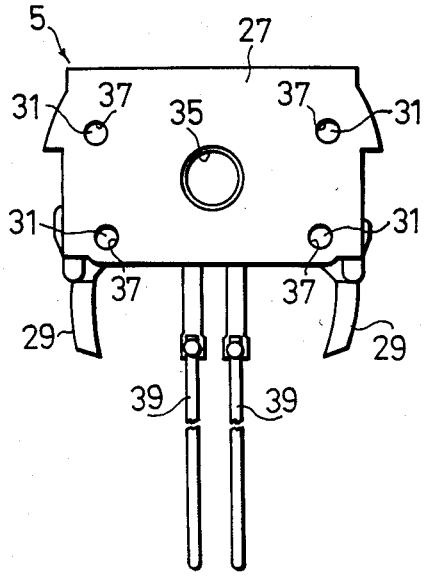
FIG. 7 is a rear elevational view of the actuator
Figure 8:
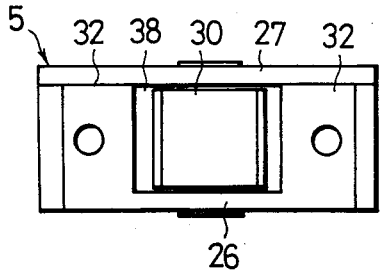
FIG. 8 is a plan view of the actuator.

The actuator or swingable lever 5 will now be described with reference to FIGS. 6 through 8. As shown in FIG. 6, the actuator 5 is constructed of a front lever plate 26, a rear lever plate 27, a pair of torsion springs 28, 28, a pair of feed pawls 29, 29, and a light-emitting element 30 such as an LED. For the ease of illustration, the front lever plate 26 and the rear lever plate 27 are shown reversed in FIG. 6 and hence located in rear and front positions, respectively.

The front lever plate 26 has a pair of upper actuating end portions 32, 32 having attachment holes in upper surfaces thereof for attaching knobs (not shown), there being a recess 33 defined between the actuating end portions 32, 32. Upper and lower pairs of connecting pins 31 project fron inner surfaces of the front lever plate 26. The lower connecting pins 31 have larger-diameter portions over which proximal ends of the feed pawls 29 are pivotally fitted, respectively. The torsion springs 28, 28 are mounted respectively on support pins 34 projecting inwardly from the front lever plate 26. The feed pawls 29, 29 are normally biased by the torsion springs 28, 28, respectively, to move their free ends inwardly toward each other.

The rear lever plate 27 has a substantially central through hole 35, and the front lever plate 26 has a substantially central connecting hole 36.

In assembly, the torsion springs 28 and the feed pawls 29 are fitted respectively over the support pins 34 and the lower connecting pins 31 on the front lever plate 26, and then distal ends of the connecting pins 31 are placed into holes 37 in the rear lever plate 27 with a force fit. The front and rear lever plates 26, 27 are thus joined together. Under this condition, as shown in FIG. 8, there is defined a space 38 between the actuating end portions 32, 32 for placing a light-emitting element portion. The assembly is then inserted into the casing 4 with the rear lever plate 27 facing the rear wall 11 and with the support shaft 14 on the rear wall 11 being fitted in the through hole 35 in the rear lever plate 27. When the assembly is thus placed in the casing 4, lower opposite ends of the rear lever plate 27 are held against the leaf spring 16 positioned between the spring supports 13 and the spring stoppers 15.

The light-emitting element 30 is one of the components of the actuator 5, but separate from the above assembly. After the assembly has been placed in the casing 4, the light-emitting element 30 is inserted into the casing 4 through the space 38 with terminals 39 directed downwardly. With the light-emitting element 30 thus inserted in the casing 4, a light-emitting portion thereof is positioned in the space 38, and lower ends of the terminals 39 project downwardly through terminal holes 40 (FIG. 4) defined in the bottom wall 10 of the casing 4.

The rotor 6 will hereinafter be described with reference to FIGS. 9 through 12. The rotor 6 comprises a gear body 41, a slider holder 42 fitted in the gear body 41, a pair of sliders 43, 43 fixed to the slider holder 42, a light-emitting element 44 such as an LED accommodated between the gear body 41 and the slider holder 42, and a pair of power supply contacts 45, 45.

Figure 11:
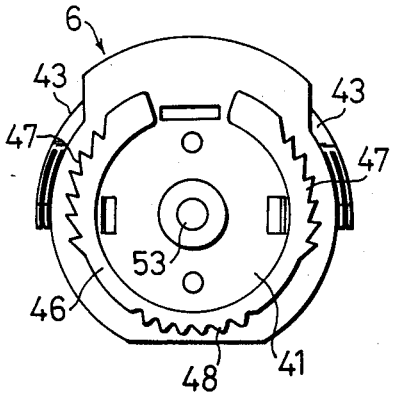
FIG. 11 is a rear elevational view of the rotor.

As illustrated in FIG. 11, a gear 46 projects from a rear surface of the gear body 41 and has feed teeth 47 defined along lateral, slightly upper peripheral edges thereof for meshing engagement with the feed pawls 29. The gear 26 also has a plurality of positioning slots 48 defined along a lower peripheral edge thereof. The positioning slots 48 and the feed teeth 47 have the same pitch. A central support shaft 53 projects from the rear surface of the gear body 41, and has a length slightly larger than the depth of the gear 46, and hence projects outwardly beyond the gear 46.

Figure 9:
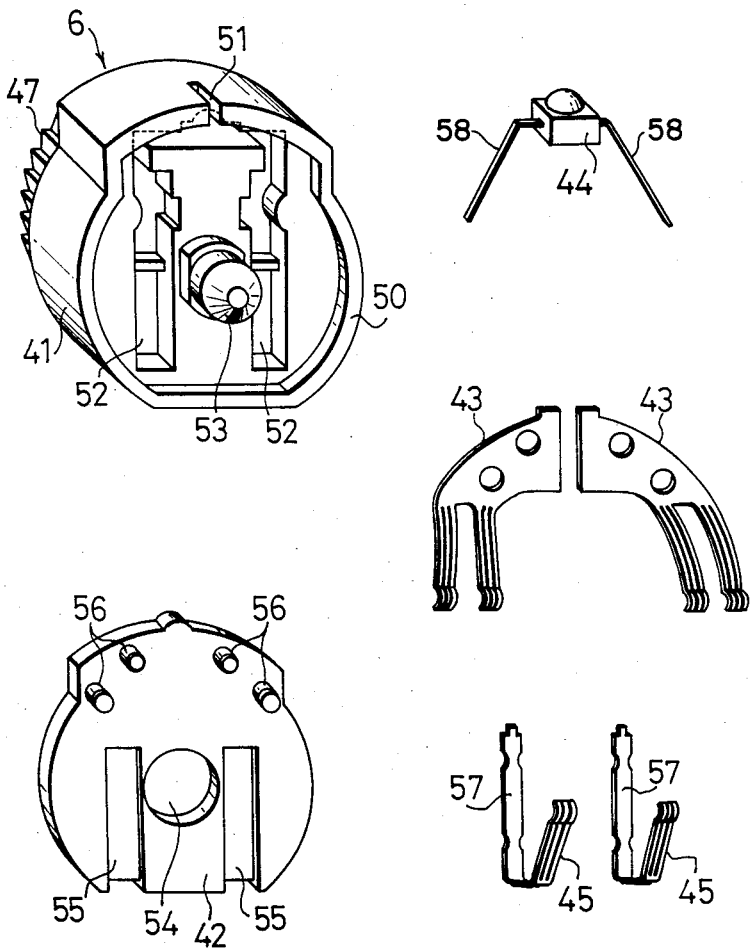
FIG. 9 is an exploded perspective view of a rotor.
Figure 12:
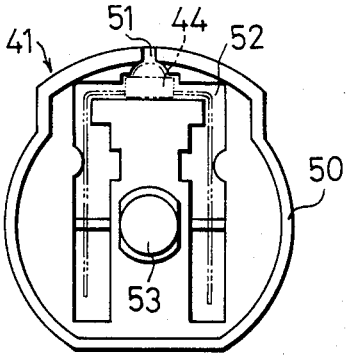
FIG. 12 is a front elevational view of a gear body.

As shown in FIGS. 9 and 12, the gear body 41 has on a front surface thereof a substantially annular peripheral wall 50 having an upper slit 51. The front surface of the gear body 41 has a groove 52 positioned below the slit 51 for housing therein the light-emitting element 44. A central shaft 53 projects from the front surface of the gear body 41 in coaxial relationship to the support shaft. The central shaft 53 has a length slightly greater than the depth of the peripheral wall 50 and hence projects outwardly beyond the peripheral wall 50.

The light-emitting element 44 is inserted and positioned in the groove 52 as indicated by the dot-and-dash line in FIG. 12 and has a light-emitting portion located in confronting relationship to the slit 51.

The slider holder 42 has a central hole 54 defined therein, a pair of clearance slots 55, 55 positioned one on each side of the central hole 54, and attachment pins 56 positioned above the hole 54 for attaching the sliders 43. The sliders 43 are mounted by the attachment pins 56 on the slider holder 42 and securely fixed thereto by thermally fusing the heads of the attachment pins 56.

Figure 10:
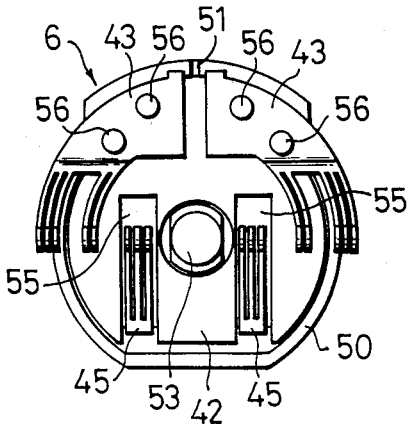
FIG. 10 is a front elevational view of the rotor.

The slider holder 42 is forcibly fitted in the peripheral wall 50 of the gear body 41 with the sliders 43 facing outwardly. At this time, the power supply contacts 45 have their proximal ends 57 (FIG. 9) sandwiched between terminals 58 of the light-emitting element 44 and the slider holder 42. Thus, the power supply contacts 45 are supported in position and held in reliable electric contact with the light-emitting element 44. As shown in FIG. 10, the portions of the power supply contacts 45 which project outwardly the slider holder 42 are positioned in confronting relationship to the slots 55 in the sliderholder 42. When the slider holder 42 is fitted in the gear body 41, the support shaft 53 on the gear body 41 has its portion projecting out through the hole 44 in the slider holder 42.

The rotor 6 thus assembled is inserted into the casing 4 so as to allow the gear wall 46 to confront the rear wall 11 of the casing 4, with the support shaft of the rotor 6 fitted in the hole 12 in the rear wall 11. The rotor 6 is thus angularly movably supported in the casing 4, and the feed pawls 29, 29 are held in mesh with the feed teeth 47, 47 on the rotor 6 while the ridge 19 of the resilient member 18 is fitted in one of the positioning slots 48.

Figure 13:
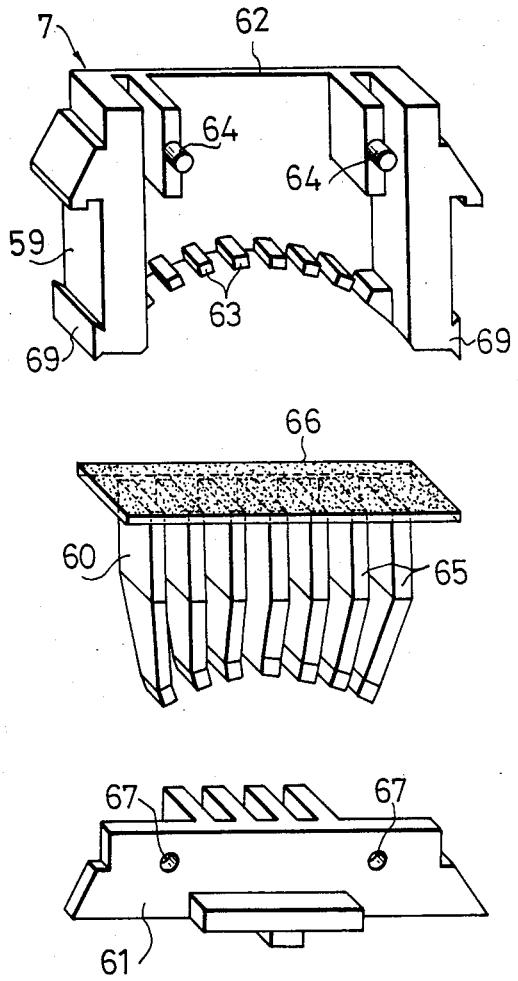
FIG. 13 is an exploded perspective view of an indicator block.
Figure 14:
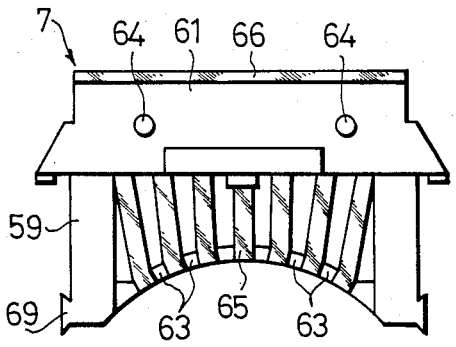
FIG. 14 is a front elevational view of the indicator block.

The indicator block 7 will now be described with reference to FIGS. 13 and 14. The indicator block 7 comprises a casing 59, a light guide group 60, and a cover 61, the casing 59 and the cover 61 being molded of an opaque synthetic resin.

The casing 59 has an inner housing recess 62 and a lower arcuate edge along which a plurality of positioning teeth 63 are disposed at certain intervals. A pair of connecting pins 64, 64 projects from the casing 59 and is positioned in an upper portion of the housing recess 62.

The light guide group 60 is composed of a plurality of light guides 65 disposed at certain intervals and an indicator plate 66 integrally joining the upper ends of the light guides 65. The guides 65 and the indicator plate 66 are integrally molded of a synthetic resin having a good light transmitting capability. The light guide group 60 has a lower end face curved arcuately in alignment with the lower arcuate edge of the casing 59. The indicator plate 66 has an upper surface roughened with a matte finish. The lower end faces of the light guides 65 are located respectively in alignment with positions in which the light-emitting element 44 in the rotor 6 can be stopped. The positioning teeth 63 on the casing 59 serve to position the lower end faces of the light guides 65 in alignment with the stop positions for the light-emitting elements 44, and also serve to shield light against leakage between the light guides 65. The number of the light guides 65 used corresponds to the number of steps of adjustment of the variable resistor 1.

The cover 61 has a pair of through holes 67, 67 in which the heads of the connecting pins 64 of the casing 59 are fitted.

The indicator block 7 is assembled as follows: The light guide group 60 is inserted and positioned in the casing 59, and then the cover 61 is placed thereon. By fitting the connecting pins 64 of the casing 59 in the holes 67 in the cover 61 and thermally fusing the heads of the connecting pins 64, the light guide group 60, the casing 59, and the cover 61 are integrally joined together into the indicator block 7.

The completed indicator block 7 is then inserted into the casing 4 with the arcuate lower surface directed downwardly until the indicator block 7 is located adjacent to the actuator 5. As shown in FIGS. 3 and 4, the inner surfaces of the side walls 9, 9 of the casing 4 have a pair of dovetail grooves 68, 68, respectively. As illustrated in FIGS. 13 and 14, the casing 59 has a pair of ridges 69, 69 on its side walls. The indicator block 7 can be positioned accurately in the casing 4 by inserting the ridges 69, 69 into the dovetail grooves 68, 68, respectively. As a result, the lower end faces of the light guides 65 can be positioned in confronting relationship to the slit 51 and hence the light-emitting element 44 in the rotor 6 with a small gap left therebetween.

Figure 15:
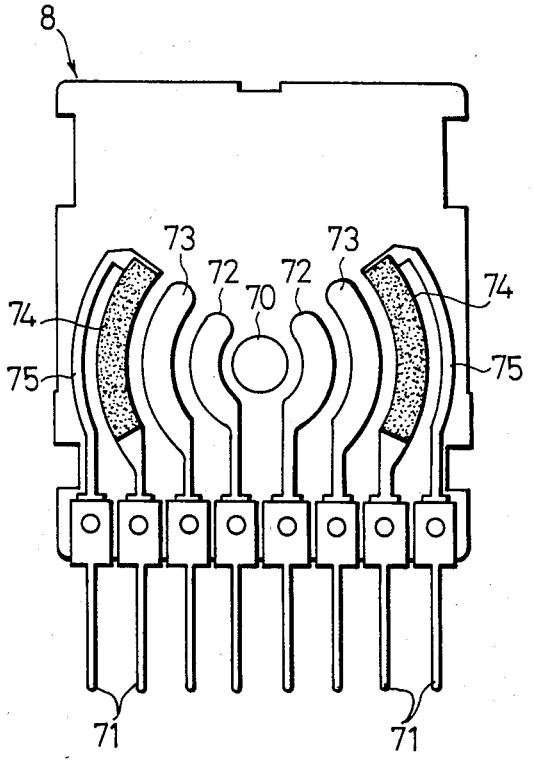
FIG. 15 is a plan view of a resistor base plate.

The resistor base plate 8 will then be described with reference to FIG. 15. The resistor base plate 8 has a substantially central support hole 70 and a prescribed number of terminals 71 mounted on a lower edge thereof.

The resistor base plate 8 supports thereon a pair of arcuate power supply conductive layers 72, 72, a pair of arcuate current collecting layers 73, 73, a pair of arcuate resistor layers 74, 74, and a pair of arcuate lead layers 75, 75, the layers in each pair being provided one on each side of the central support hole 70 and successively arranged radially outwardly in the order named.

When the resistor base plate 8 is inserted in the casing 4, the resistor base plate 8 is fixed in position in the front open side of the casing 4 by the locking hooks 17 thereof. With the resistor base plate 8 thus mounted, the support shaft 53 projecting from the rotor 6 is inserted in the support hole 70 in the resistor base plate 8. As a result, the rotor 6 is pivotally supported between the casing 4 and the resistor base plate 8 by the support shafts 49, 53 on the rotor 6. The the distal ends of the sliders 43 project from the rotor 6 and are held in resilient contact with the current collecting layers 73 and the resistor layers 74 on the resistor base plate 8. The power supply contacts 45 have distal ends projecting from the rotor 6 and kept in resilient contact with the power supply conductive layers 72. Accordingly, the light-emitting element 44 is supplied with an electric current no matter where the rotor 6 may be angularly positioned with respect to the resistor base plate 8 and hence the casing 4.

Figure 16:
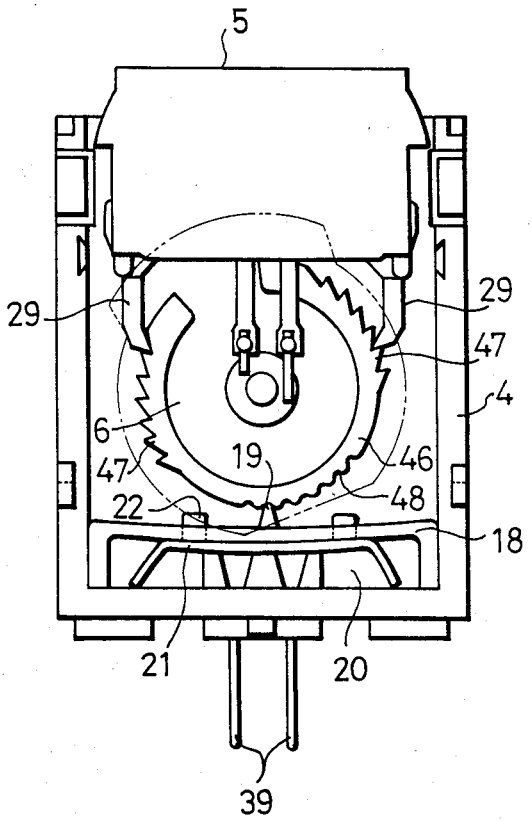
FIGS. 16 and 17 are front elevational views, partly cut away, of the variable resistor.
Figure 17:
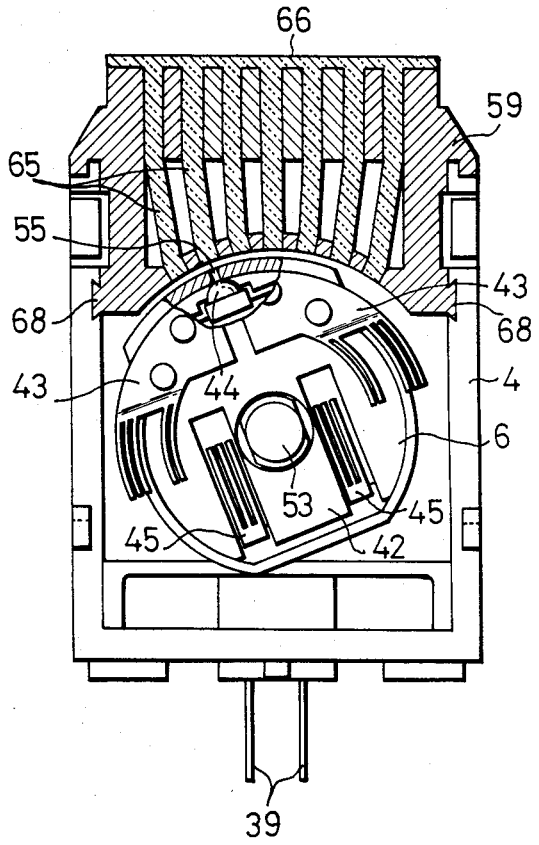

FIGS. 16 and 17 show the variable resistor 1 as completely assembled. The lateral feed pawls 29, 29 of the actuator 5 are held in mesh with the lateral feed teeth 47, 47, respectively, of the rotor 6. The ridge 19 of the resilient member 18 in the casing 4 is resiliently fitted in one of the positioning slots 48 in the rotor 6 under the resilient force of the leaf spring 21, so that the rotor 6 can be held in its angular position with respect to the casing 4.

The actuator 5, except the light-emitting element 30, is swingably supported by the support shaft 14 of the casing 4. When the lefthand actuating end portion 32, as shown in FIG. 16, is depressed through the knob (not shown), the actuator 5 is turned counterclockwise through a predetermined angle against the resiliency of the leaf spring 21. The feed teeth 47 which are held in mesh with the lefthand feed pawl 29 are then forced downwardly to cause the rotor 6 to turn counterclockwise about the support shafts 49, 53 against the resilient forces of the resilient member 18 and the leaf spring 21. The angular movement of the rotor 6 allows the ridge 19 to fit into an adjacent, leftward positioning slot 48, whereupon the rotor 6 is angularly shifted into another angular position. The sliders 43 now contact the resistor layers 74 at different positions, thus varying the resistance of the variable resistor, and the slit 51 faces an adjacent, leftward light guide 65. The light-emitting element 44 mounted in the rotor 6 is kept energized at all times while the audio device in which the variable resistor 1 is incorporated is in operation, and light emitted from the light-emitting element 44 passes through the slit 51 into the light guide 65 which the slit 51 faces now, whereupon a different position on the indicator plate 66 is illuminated. Where the variable resistor 1 is employed in a frequency regulator, it can adjust the output level thereof and display the adjusted output level optically.

When the knob on the actuating end portion 32 is released of a manual push, the actuator 5 returns to the original position under the bias of the left spring 21, and the feed pawls 29 are brought into mesh with the next succeeding feed teeth 47 in preparation for a next cycle of resistance adjustment.

When the righthand actuating end portion 32 is manually depressed, the variable resistor 1 operates conversely for adjusting the resistance and changing the illuminated position on the indicator plate 66.

The size of the space 38 defined between the front and rear lever plates 26, 27 for placing therein the light-emitting portion of the light-emitting element 30 is designed such that the actuator 5 (except the light-emitting element 30) as it swings will not abut against the light-emitting element 30. The light-emitting element 30 in the actuator 5 is supported by the casing 4 and remains immovable. The light-emitting element 30 radiates light when the variable resistor 1 is operated upon, that is, when the output level of a selected frequency is adjusted, thereby indicating that the variable resistor 1 is being actuated.

With the foregoing arrangement, the resistance of the variable resistor 1 can be varied simply by pushing the actuator 5 angularly back and forth. Therefore, the variable resistor 1 of the invention can be acuated more easily with a smaller force than would be a variable resistor having a knob rotatable for changing the resistance. The variable resistor 1 is particularly advantageous when used in a vehicle-mounted frequency regulator since the variable resistor 1 can easily be operated upon by pushing the actuator 5 angularly back and forth, and hence contributes to the safe operation of the vehicle.

Since the light-emitting portion of the light-emitting element 30 is positioned centrally in the actuator 5, that is, between the actuating end portions 32, 32 thereof, and can indicate the operation of the actuator 5 through light emission from the light-emitting portion, the operator can easily confirm the position of the actuator 5 as operated upon. Therefore, the ease with which the variable resistor 1 is actuated is further improved.

Although a certain preferred embodiment has been shown and described, it should be understood that many changes and modifications may be made therein without departing from the scope of the appended claims.

What is claimed is:

1. A variable resistor comprising:

(a) a casing;

(b) an actuator having an intermediate portion pivotally supported by said casing, a pair of opposite actuating end portions exposed from said casing, and a pair of opposite feed pawls;

(c) a rotor pivotally supported by said casing between said opposite feed pawls, said rotor having on peripheral edges thereof teeth meshing with said feed pawls and carrying a slider;

(d) a resistor base plate mounted on said casing and having an arcuate resistor layer facing said slider of said rotor; and (e) said actuator adapted to be pivoted in response to depression of one at a time of said actuating end portions thereof for turning said rotor in one direction through meshing engagement between said feed pawls and said teeth to thereby cause said slider to slide on said arcuate resistor layer, whereby the resistance of said variable resistor can be varied.

2. A variable resistor according to claim 1, wherein said actuator has a space defined between said actuating end portions, including a light-emitting element disposed in said space and isolated from said actuator and energizable in response to actuation of said actuator for emitting light indicative of the actuation of the latter.

3. A variable resistor according to claim 1, wherein said opposite feed pawls are pivotably mounted on the actuator and have free ends for meshing with the teeth of said rotor where the free ends are urged inwardly toward each other by spring means.

4. A variable resistor according to claim 1, further comprising a leaf spring for normally biasing the actuator and wherein said casing has a projection on one wall thereof for supporting an intermediate portion of the leaf spring, and the actuator engages with opposite ends of the leaf spring.

* * * * *